US006630818B1

(12) United States Patent
Comer et al.

(10) Patent No.: US 6,630,818 B1
(45) Date of Patent: Oct. 7, 2003

(54) CURRENT MIRROR CIRCUITS

(75) Inventors: David J. Comer, Springville, UT (US); Aaron K. Martin, Hillsboro, OR (US); James E. Jaussi, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/106,757

(22) Filed: Mar. 26, 2002

(51) Int. Cl.[7] ..... G05F 3/16; G05F 1/10
(52) U.S. Cl. ..... 323/315; 327/538
(58) Field of Search ..... 323/315, 313, 323/314, 312, 311, 907; 327/538, 540, 541; 330/288, 277, 307, 300

(56) References Cited

U.S. PATENT DOCUMENTS 4,792,748 A * 12/1988 Thomas et al. ..... 323/312
5,079,518 A * 1/1992 Wakayama ..... 330/288

OTHER PUBLICATIONS

Rajput, S.S., et al., "A High Performance Current Mirror for Low Voltage Designs", *IEEE Catalog No. 00EX394*, (2000), pp. 170–173, No date.

* cited by examiner

*Primary Examiner*—Rajnikant B. Patel
(74) *Attorney, Agent, or Firm*—Schwegman, Lundberg, Woessner & Kluth, P.A.

(57) ABSTRACT

A current mirror includes an input node to receive an input current, an output node to produce an output current, and a reference node. The current mirror also includes a potential reduction unit to allow the voltage at the input node to be less than the voltage at the reference node.

20 Claims, 4 Drawing Sheets

CURRENT MIRROR CIRCUITS

FIELD

Embodiments of the present invention relate generally to integrated circuits, and in particular to integrated circuits that include current mirrors.

BACKGROUND

Current mirrors are popular structures that exist in many electrical circuits. Some circuits use a current mirror to reproduce, or "mirror," an input current to obtain an output current. In most cases, the output and input currents have the same value. In some cases, the output current is proportional to the input current.

FIG. 1 shows a conventional current mirror 100. Current mirror 100 has a transistor 112 connected to an input node 116 to receive an input current Iin. Transistor 112 connects to another transistor 114 at a reference node 118. Transistor 114 provides an output current Iout. The input node has an input voltage Vin. The reference node has a reference voltage Vref. Transistor 112 has its drain and gate connected together at both the input and reference nodes. Since the input and reference nodes connect together, Vin equals, Vref. Transistors 112 and 114 typically have the same construction such that they are matched. Hence, Iout flowing through transistor 112 equals Iin flowing through transistor 114.

In a typical circuit that includes current mirror 100, the value of Vin is insignificant in comparison to the supply voltage of the circuit. However, as the trend in reducing supply voltage of circuits becomes a necessity for some applications, the value of Vin becomes a significant issue. In some circuits with reduced supply voltage, Vin needs to be reduced to maintain a proper headroom voltage so that the circuits operate properly. However, because nodes 116 and 118 connect together, reducing Vin at node 116 also reduces Vref at node 118. In some applications, Vref needs to remain at certain value to drive transistor 414. Therefore, in some applications, as the supply voltage is reduced, current mirror 100 will operate improperly. For For these and other reasons stated below, and which will become apparent to those skilled in the art upon reading and understanding the present specification, there is a need for improved current mirrors.

DESCRIPTION OF EMBODIMENTS

Figure 1:
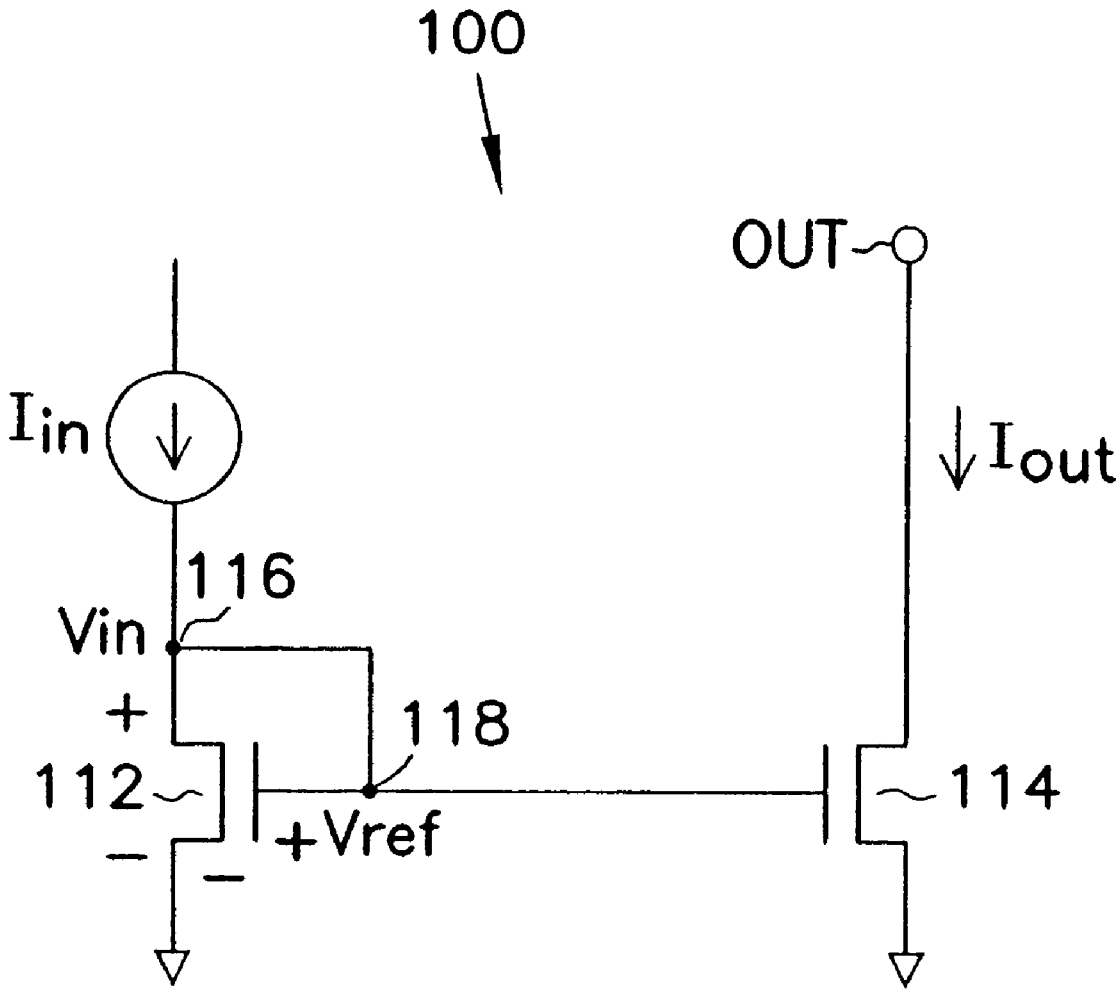
FIG. 1 (PRIOR ART)
FIG. 1 shows a conventional current mirror.

The following detailed description of the embodiments refer to the accompanying drawings that show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be used and structural, logical, and electrical changes may be made without departing from the scope of the present invention. Moreover, the various embodiments of the invention, although different, are not necessarily mutually exclusive. For example, a particular feature, structure, or characteristic described in one embodiment may be included within other embodiments. Therefore, the following detailed description is not to be taken in a limiting sense, and the scope of the present. invention is defined only by the appended claims, along with the full scope of equivalents to which such claims are entitled.

Figure 2:
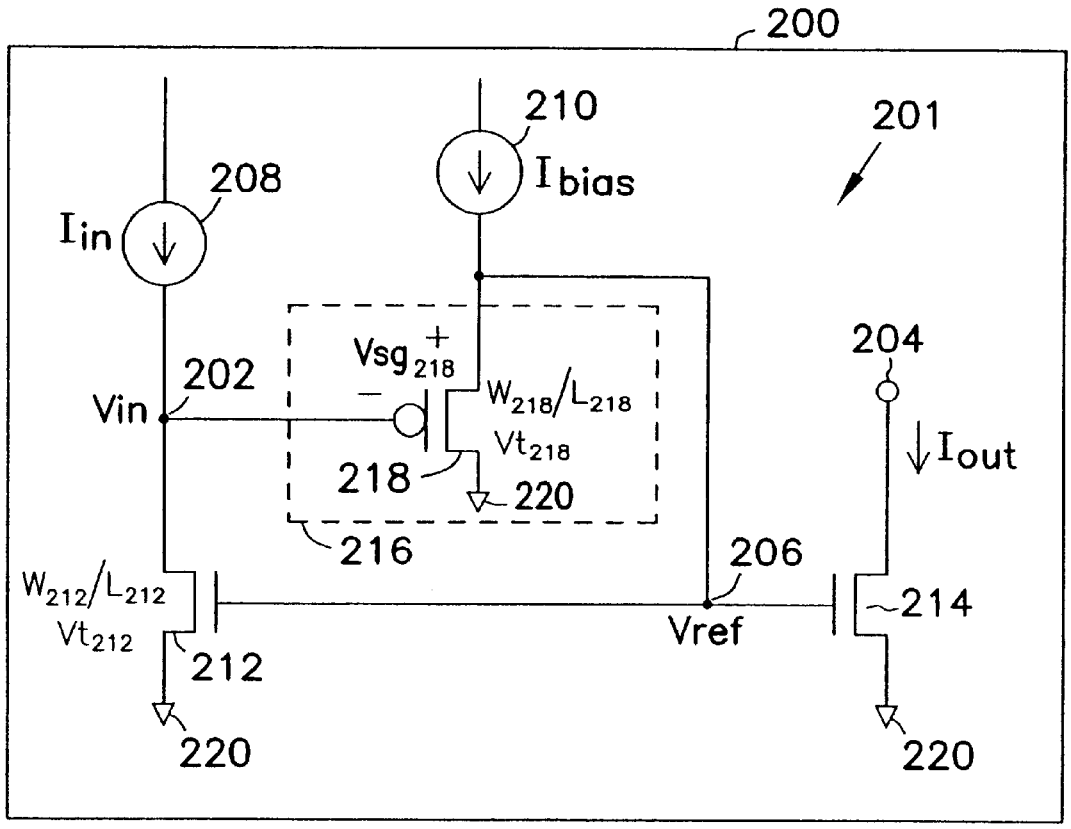
FIG. 2 shows an integrated circuit with a current mirror.

FIG. 2 shows an integrated circuit with a current mirror. Integrated circuit 200 includes a current mirror 201. Current mirror 201 includes an input node 202, an output node 204, a reference node 206, an input current source 208, a bias current source 210, transistors 212 and 214, and a potential reduction unit 216.

Input node 202 connects to input current source 208 to receive an input current Iin. Output node 204 provides an output current Iout. Bias current source 210 provides a bias current Ibias. Input node 202 has an input voltage Vin. Reference node 206 has a reference voltage Vref.

Transistor 212 includes a gate connected to node 206, a drain connected to node 202, and a source connected to a supply node 220. Transistor 214 includes a gate connected to node 206, a drain connected to node 204, and a source connected to supply node 220.

In embodiments represented by FIG. 2, potential reduction unit 216 includes a potential reduction transistor 218, which has a gate connected to node 202, a source connected to node 206, and a drain connected to node 220.

Potential reduction unit 216 causes the voltage at node 202 to be less than the voltage at node 206 to decrease the required input headroom voltage of integrated circuit 200. In embodiments represented by FIG. 2, transistor 218 represents one implementation of potential reduction unit 216. Other implementations of potential reduction unit 216 can be achieved without departing from the scope of the present invention.

Transistors 212 and 214 are n-channel metal oxide semiconductor field effect transistors (NMOSFETs), also referred to as "NFETs" or "NMOS". Transistor 218 is a p-channel metal oxide semiconductor field effect transistor (PMOSFET) also referred to as "PFET" or "PMOS". In other embodiments, the type of each of transistors 212, 214, and 218 are reversed. For example, in some embodiments, transistors 212 and 214 are PMOS transistors, and transistor 218 is an NMOS transistor.

Other types of transistors can also be used in place of the NMOS and PMOS transistors of FIG. 2. For example, embodiments exist that use bipolar junction transistors (BJTs) and junction field effect transistors (JFETs). One of ordinary skill in the art will understand that many other types of transistors can be used without departing from the scope of the present invention.

Transistors 212 and 218 have a channel width W and a channel length'L, and' a channel width to channel length ratio of W/L. In FIG. 2, $W_{212}$, $L_{212}$, and $W_{212}/L_{212}$ indicate the channel width, channel length, and channel width to channel length ratio of transistor 212, respectively. $W_{218}$, $L_{218}$, and $W_{218}/L_{218}$ indicate the channel width, channel length, and channel width to channel length ratio of transistor 218, respectively.

Transistors 212 and 218 have a threshold voltage Vt. The threshold voltage of a transistor is a voltage at which the transistor turns on. Specifically, the threshold voltage of a transistor is the voltage applied between the gate and the source of the transistor below which the drain-to-source current effectively drops to zero. The threshold voltage depends on the parameters of the transistor, for example, channel length and channel width of the transistor. As shown in FIG. 2, the threshold voltage of transistor 212 is indicated $Vt_{212}$. The threshold voltage of transistor 218 is indicated $Vt_{218}$. Transistor 218 has a source-to-gate voltage indicated by $Vsg_{218}$.

In some embodiments, $W_{212}/L_{212}$ and $W_{218}/L_{218}$ are selected such that transistor 212 operates in the saturation mode and $Vsg_{218}$ is less than $Vt_{212}$. In other embodiments, transistors 212 and 218 have different structures such that $W_{218}/L_{218}$ is smaller than $W_{212}/L_{212}$, or $W_{212}$ equals $W_{218}$, and $L_{218}$ is longer than $L_{212}$.

Further, in some embodiments, bias current source 210 is adjusted or configured such that $Vsg_{218}$ is less than $Vt_{212}$. For example, in some embodiments, bias current source 210 is adjusted or configured to produce less current than input current source 208.

During operation, Vref turns on both transistors 212 and 214. Iin passes through transistor 212, and Iout passes through transistor 214. In embodiments represented by FIG. 2, transistors 212 and 214 have substantially the same construction. Therefore, Iin equals Iout. In some embodiments, transistors 212 and 214 have different constructions. In these embodiments, Iin and Iout are unequal but proportional. In FIG. 2, Ibias and the construction of transistor 218 are appropriately selected so that potential reduction unit 216 causes Vin to be less than Vref.

In embodiments represented by FIG. 2, the value of $Vsg_{218}$ depends 'on the' value of Ibias and the construction of transistor 218. The construction of transistor 218 refers to process parameters and device geometry of transistor 218. The relationship between the Vin, Vsg, and Vref can be expressed by equation (1) as follows:

$$Vin=Vref-Vsg_{218}. \quad (1)$$

In FIG. 2, $Vsg_{218}$ is a positive quantity. Therefore, Vin is less than Vref, based on equation (1).

In some embodiments, transistor 212 operates in a saturation mode (or active mode). Operating in the saturation mode ensures that Iin is not substantially affected by changes in drain-to-source voltage of transistor 212 for any particular gate voltage at the gate of transistor 212. When Iin is not substantially affected, Iout is also not substantially affected. Therefore, operating in the saturation mode maintains the equivalence between Iin and Iout.

For transistor 212 to operate in the saturation mode, its drain-to-source voltage ($Vds_{212}$) is greater than its gate-to-source voltage ($Vgs_{212}$) minus its threshold voltage. ($Vt_{212}$) and $Vsg_{218}$ is less than $Vt_{212}$. In the saturation mode, the relationship among $Vds_{212}$, $Vgs_{212}$, and $Vt_{212}$ of transistor 212 is shown in expression (2) as follows:

$$Vds_{212} \geqq Vgs_{212}-Vt_{212}. \quad (2)$$

In FIG. 2, $Vds_{212}$ equals Vin, and $Vgs_{212}$ equals to Vref. Therefore, when transistor 212 operates in the saturation mode, the relationship among these voltages is given by expression (3) or (4) as follows:

$$Vin \geqq Vref-Vt_{212} \quad (3)$$

$$\text{or equivalently, } Vref-Vin \leqq Vt_{212}. \quad (4)$$

Equation (1) above can be written as equation (5) below:

$$Vref-Vin=Vsg_{218}. \quad (5)$$

By substituting Vref−Vin in equation (5) into expression (4), the relationship between $Vt_{212}$ and $Vsg_{218}$ is shown in expression (6), $$Vsg_{218} \leqq Vt_{212}. \quad (6)$$

As described previously, $Vt_{212}$ is the threshold voltage of transistor 212, and $Vsg_{218}$ is the source-to-gate voltage of transistor 218. Further, when a transistor turns on, its absolute gate-to-source voltage is equal to or greater than its threshold voltage. For example, when transistor 212 turns on, $Vgs_{212}$ is equal to or greater than $Vt_{212}$. When transistor 218 turns on, $Vsg_{218}$ (or absolute value of its Vgs) is equal to or greater than $Vt_{218}$. Thus, if $Vt_{218}$ was greater than $Vt_{212}$ in FIG. 2, expression (6) would begin to fail when transistor 218 turns on and when transistor 212 operates in the saturation mode. Therefore, in embodiments where transistor 212 operates in the saturation mode, to substantially satisfy equation (6), $Vt_{218}$ is less than $Vt_{212}$. In embodiments when transistor 212 operates in a non-saturation mode (or linear, or triode mode,) $Vsg_{218}$ can be greater than $Vt_{212}$.

Figure 3:
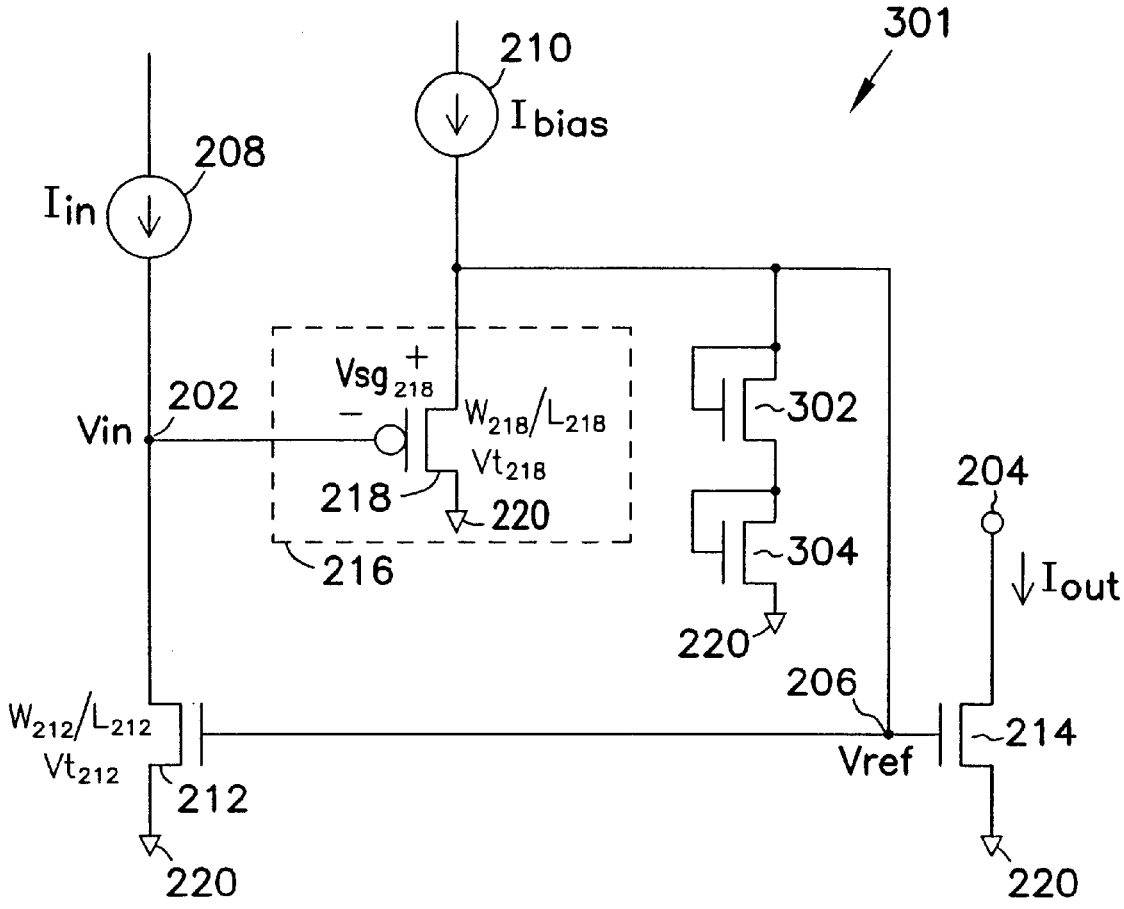
FIG. 3 shows a modified version of the current mirror of FIG. 2.

FIG. 3 shows a modified version of the current mirror of FIG. 2. Current mirror 301 is similar to current mirror 201 (FIG. 2). In embodiments represented by FIG. 3, current mirror 301 includes transistors 302 and 304 in addition to other elements that are similar to elements of current mirror 201 of FIG. 2. Transistors 302 and 304 are n-channel transistors (or NMOS). However, in other embodiments, transistors 302 and 304 can be other types of transistors, for example, PMOS transistors.

Transistor 302 has a gate and a drain connected together at the source of transistor 218 at node 206, and a source connected to transistor 304. Transistor 304 has a gate and a drain connected to the source of transistor 302, and a source connected to node 220. Transistors 302 and 304 are diode-connected transistors. The term "diode-connected transistor" refers to a transistor that has a gate connected to a drain, such that the gate-to-source voltage and the drain-to-source voltage are equal. In embodiments represented by FIG. 3, transistors 302 and 304 connect in series with each other and in between nodes 206 and 220. In other embodiments, diodes are used in placed of transistors 302 and 304.

The operation of current mirror 301 is similar to the operation of current mirror 201. Current mirror 301 receives Iin and outputs Iout. In embodiments represented by FIG. 3, Iin equals Iout. In some embodiments, Iin and Iout are not equal. In some embodiments, bias current source 210 is configured to produce more current than input current source 208. In embodiments represented by FIG. 3, Vin is less than Vref. Because of the addition of transistors 302 and 304 in FIG. 3, Vin of FIG. 3 is greater than Vin of FIG. 2.

In embodiments represented by FIG. 3, potential reduction unit 216 causes Vin to be less than Vref. In FIG. 3, the voltage of the source of transistor 218 equals $Vgs_{302}+Vgs_{304}$. $Vgs_{302}$ and $Vgs_{304}$ are the gate-to-source voltages of transistors 302 and 304, respectively. Transistor 218 causes Vin to be unequal to the voltage of node 206. Specifically, Vin equals $Vgs_{302}+Vgs_{304}-Vsg_{218}$. In embodiments represented by FIG. 3, the gate-to-source voltages of a transistor equals the difference between the gate voltage and source voltage of the transistor. For example, $Vgs_{302}$ equals the difference between the gate voltage and source voltage of transistor 302.

Figure 4:
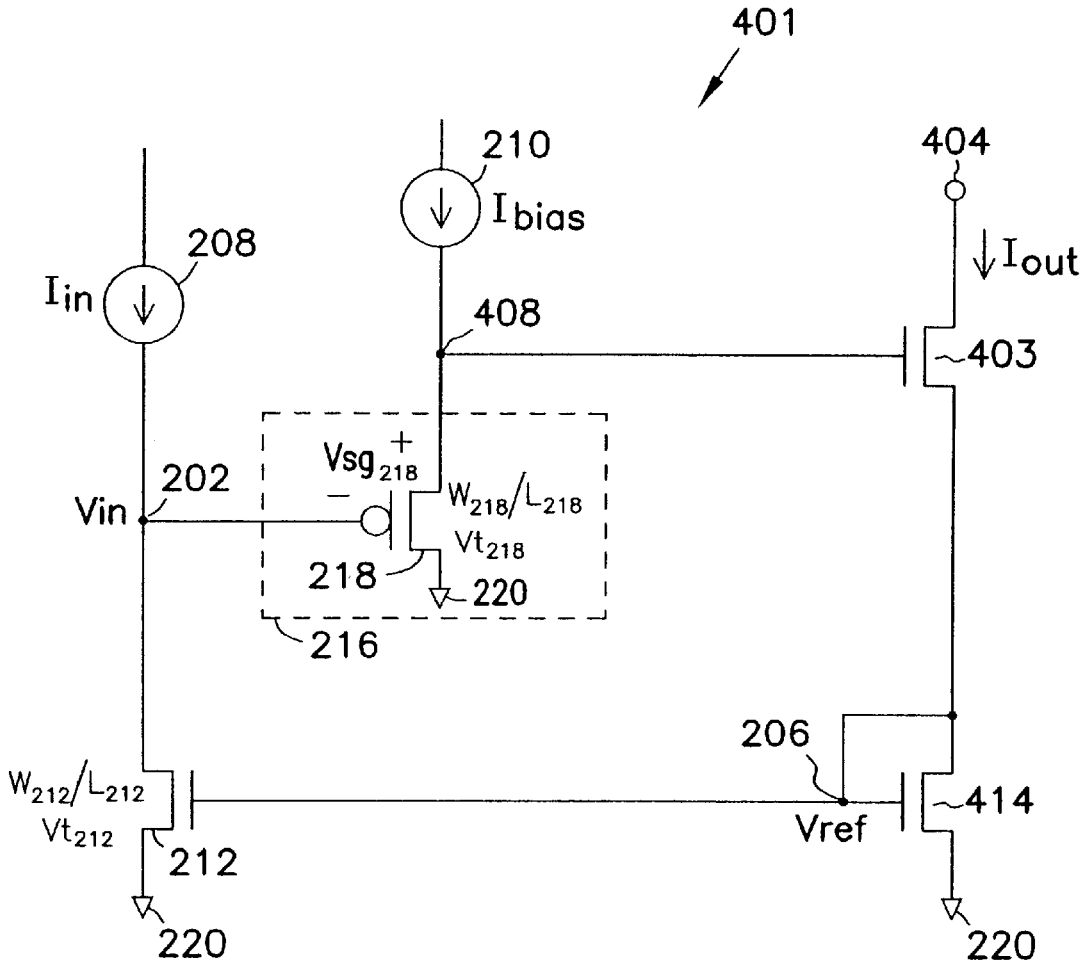
FIG. 4 shows a modified version of the current mirrors of FIG. 2 and FIG. 3.

FIG. 4 shows a modified version of the current mirrors of FIG. 2 and FIG. 3. Current mirror 401 includes a transistor 403 in addition to other elements that are similar to element current mirror 201 (FIG. 2) and current mirror 301 (FIG. 3). In embodiments represented by FIG. 4, transistor 403 includes a gate connected to the source of transistor 218 at a bias node 408, a drain connected to an output node 404, and a source connected to the drain of transistor 414 at node 206. The gate and drain of transistor 414 connect together at node 206. Node 404 provides Iout.

The operation of current mirror 401 is similar to the operation of current mirror 201 and current mirror 301. Current mirror 401 receives Iin and outputs Iout. In some embodiments, Iin and Iout are unequal, and Iin and Ibias are unequal. Potential reduction unit 216 causes Vin to be less than the voltage of node 408. Further, transistor 403 causes current mirror 401 to have higher output impedance than current mirror 201 or current mirror 301.

In embodiments represented by FIG. 4, potential reduction unit 216 causes Vin to be less than the voltage of node 408. In FIG. 4, the voltage of node 408 equals $Vgs_{403}+Vgs_{414}$. $Vgs_{403}$ and $Vgs_{414}$ are the gate-to-source voltages of transistors 403 and 414, respectively. Transistor 218 causes Vin to be unequal to the voltage of node 408. Specifically, Vin equals $Vgs_{403}+Vgs_{414}-Vsg_{218}$.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. An integrated circuit comprising:

a first transistor including a gate connected to a reference node, a drain connected to an input node, and a source connected to a supply node;

a second transistor including a gate connected to the reference node, a drain connected to an output node, and a source connected to the supply node;

a potential reduction unit connected between the input and reference nodes; and at least one diode connected between the reference node and the supply node.

2. The integrated circuit of claim 1, wherein the potential reduction unit includes a potential reduction transistor having a gate connected to the input node, a source connected to the reference node, and a drain connected to the supply node.

3. The integrated circuit of claim 2, wherein the potential reduction transistor and the first transistor have unequal channel width to channel length ratios.

4. The integrated circuit of claim 2, wherein a threshold voltage of the potential reduction transistor is less than a threshold voltage of the first transistor.

5. The integrated circuit of claim 1 further comprising an input current source connected to the input node.

6. The integrated circuit of claim 5 further comprising a bias current source connected to the reference node.

7. The integrated circuit of claim 6, wherein the potential reduction transistor and the first transistor have substantially equal channel widths and unequal channel lengths.

8. The integrated circuit of claim 6, wherein the bias current source is configured to produce less current than the input current source.

9. A circuit comprising:

a first transistor including a gate connected to a reference node, a drain connected to an input node, and a source connected to a supply node;

a second transistor including a gate connected to the reference node, a drain connected to an output node, and a source connected to the supply node;

a third transistor including a gate connected to the input node, a source connected to the reference node, and a drain connected to the supply node; and a first diode-connected transistor connected between the reference node and the supply node.

10. The circuit of claim 9, further comprising a second diode-connected transistor connected in series with the first diode-connected transistor and in between the reference node and the supply node.

11. The circuit of claim 9 further comprising an input current source connected to the input node to provide an input current.

12. The circuit of claim 11 further comprising a bias current source connected to the reference node to provide a bias current.

13. The circuit of claim 12, wherein the bias current source and the input current source are configured to produce unequal currents.

14. A circuit comprising:

a first transistor including a drain connected to an input node, a source connected to a supply node, and a gate connected to a reference node;

a second transistor including a drain and a gate connected together at the reference node, and a source connected to the supply node;

a third transistor including a drain connected to an output node, a source connected to the reference node, and a gate connected to a bias node; and a potential reduction unit connected between the input and bias nodes.

15. The circuit of claim 14, wherein the potential reduction unit includes a potential reduction transistor having a gate connected to the input node, a source connected to the bias node and a drain connected to the supply node.

16. The circuit of claim 15, wherein the potential reduction transistor and the first transistor have unequal channel width to channel length ratios.

17. The circuit of claim 15 further comprising an input current source connected to the input node.

18. The circuit of claim 17 further comprising a bias current source connected to the bias node.

19. The circuit of claim 18, wherein the potential reduction transistor and the first transistor have unequal channel lengths.

20. The circuit of claim 18, wherein the bias current source and the input current source are configured to produce unequal currents.

* * * * *